US010573290B2

(12) United States Patent
Han et al.

(10) Patent No.: US 10,573,290 B2
(45) Date of Patent: Feb. 25, 2020

(54) VIRTUAL ENGINE SOUND SYSTEM FOR VEHICLE

(71) Applicants: HYUNDAI MOTOR COMPANY, Seoul (KR); KIA MOTORS CORPORATION, Seoul (KR)

(72) Inventors: Jong Wan Han, Suwon-si (KR); Seung Mo Ko, Seongnam-si (KR); Yoon Geun Cho, Daegu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/198,394

(22) Filed: Nov. 21, 2018

(65) Prior Publication Data

US 2019/0385584 A1 Dec. 19, 2019

(30) Foreign Application Priority Data

Jun. 18, 2018 (KR) ..... 10-2018-0069818

(51) Int. Cl.
*G10K 11/178* (2006.01)

(52) U.S. Cl.
CPC ..... *G10K 11/17823* (2018.01); *G10K 2210/1282* (2013.01); *G10K 2210/3044* (2013.01)

(58) Field of Classification Search
CPC ..... G10K 11/17823; G10K 2210/3044; G10K 2210/1282
See application file for complete search history.

(56) References Cited

U.S. PATENT DOCUMENTS

| | | | | |
|---|---|---|---|---|
| 5,850,458 | A * | 12/1998 | Tomisawa | F02M 35/125 381/71.4 |
| 6,758,304 | B1 * | 7/2004 | McLean | F02M 35/125 123/184.57 |
| 8,948,408 | B2 | 2/2015 | Jeong et al. | |
| 9,966,057 | B1 * | 5/2018 | Wang | F02N 11/0814 |
| 2007/0182525 | A1 * | 8/2007 | McCarthy | G10K 15/02 340/425.5 |
| 2007/0186895 | A1 * | 8/2007 | Ochi | F02M 35/14 123/198 E |

(Continued)

FOREIGN PATENT DOCUMENTS

| | | |
|---|---|---|
| JP | H3-281976 A | 12/1991 |
| JP | H8-254163 A | 10/1996 |

(Continued)

*Primary Examiner* — Ping Lee
(74) *Attorney, Agent, or Firm* — Knobbe Martens Olson & Bear LLP

(57) ABSTRACT

A virtual engine sound system for a vehicle includes: a speaker mounted on an intake system, and generating an anti-noise sound with inverted phase to an engine noise of an internal combustion engine or a virtual sound; and a valve which is movable between an open position in which an outlet of an air cleaner is opened and a closed position in which the outlet of the air cleaner is closed. The speaker is controlled by an ECU, and the valve is controlled by a valve controller. The ECU controls the speaker to generate the anti-noise sound in an operating condition in which the internal combustion engine is operating, and controls the speaker to generate the virtual sound in an operating condition in which the internal combustion engine is not operating.

7 Claims, 5 Drawing Sheets

(56) References Cited

U.S. PATENT DOCUMENTS

| | | | | |
|---|---|---|---|---|
| 2017/0234179 | A1* | 8/2017 | Petley | B60Q 5/008<br>381/71.1 |
| 2018/0163650 | A1* | 6/2018 | Serrano | G10K 11/16 |

FOREIGN PATENT DOCUMENTS

| | | | |
|---|---|---|---|
| JP | 2014-118815 | A | 6/2014 |
| KR | 10-1995-0019149 | A | 7/1995 |
| KR | 10-1998-0036396 | A | 8/1998 |
| KR | 10-2012-0045814 | A | 5/2012 |
| KR | 10-2017-0062210 | A | 6/2017 |

* cited by examiner

VIRTUAL ENGINE SOUND SYSTEM FOR VEHICLE

CROSS-REFERENCE TO RELATED APPLICATION

This application is based on and claims the benefit of priority to Korean Patent Application No. 10-2018-0069818, filed on Jun. 18, 2018, in the Korean Intellectual Property Office, the disclosure of which is incorporated herein in its entirety by reference.

TECHNICAL FIELD

The present disclosure relates to a virtual engine sound system for a vehicle.

BACKGROUND

Recently, with the development of automobile technology, much attention has been given to environmentally friendly vehicles including electric vehicles powered by electric motors and fuel cell vehicles powered by electricity from fuel cells, as well as hybrid vehicles powered by electric motors and engines.

When the environmentally friendly vehicle is operating in EV mode, that is, in an operating condition in which the vehicle is driven by the electric motor, noise generated by the vehicle while driving may be excessively low and much smaller than that from an internal combustion engine such that it may be difficult for pedestrians (especially, those who are blind or visually impaired) to perceive approach of the vehicle, causing a safety accident.

To address this issue, a virtual engine sound system (VESS) that emits a virtual engine sound to the outside of the vehicle through a speaker to allow pedestrians to be aware of the vehicle approaching has been mounted in the environmentally friendly vehicles.

SUMMARY

An aspect of the present disclosure provides a virtual engine sound system for a vehicle, capable of effectively transmitting a virtual sound to the outside of an environmentally friendly vehicle when operating in EV mode, and effectively reducing an engine noise when an internal combustion engine is operating.

According to an aspect of the present disclosure, a virtual engine sound system for a vehicle may include: a speaker mounted on an intake system, and generating an anti-noise sound with inverted phase to an engine noise of an internal combustion engine or a virtual sound; a valve which is movable between an open position in which an outlet of an air cleaner is opened and a closed position in which the outlet of the air cleaner is closed; an ECU or one or more controllers controlling the speaker; and a valve controller controlling the valve, wherein the ECU controls the speaker to generate the anti-noise sound in an operating condition in which the internal combustion engine is operating, and controls the speaker to generate the virtual sound in an operating condition in which the internal combustion engine is not operating.

The speaker may be mounted on at least one of the air cleaner and an upstream side intake conduit connected to an inlet of the air cleaner.

The speaker may be mounted to face a cavity of the air cleaner.

The speaker may be mounted to face an inside of the upstream side intake conduit.

The valve controller may control the valve to move between the open position and the closed position, depending on whether the internal combustion engine is operating.

The valve controller may control the valve to move to the open position when the internal combustion engine is operating.

The valve controller may control the valve to move to the closed position when the internal combustion engine is not operating.

The valve may be mounted in a downstream side intake conduit connected to the outlet of the air cleaner, and the valve may be disposed adjacent to the outlet of the air cleaner.

BRIEF DESCRIPTION OF THE DRAWINGS

The above and other aspects, features and advantages of the present disclosure will be more apparent from the following detailed description taken in conjunction with the accompanying drawings.

DETAILED DESCRIPTION

Figure 1:
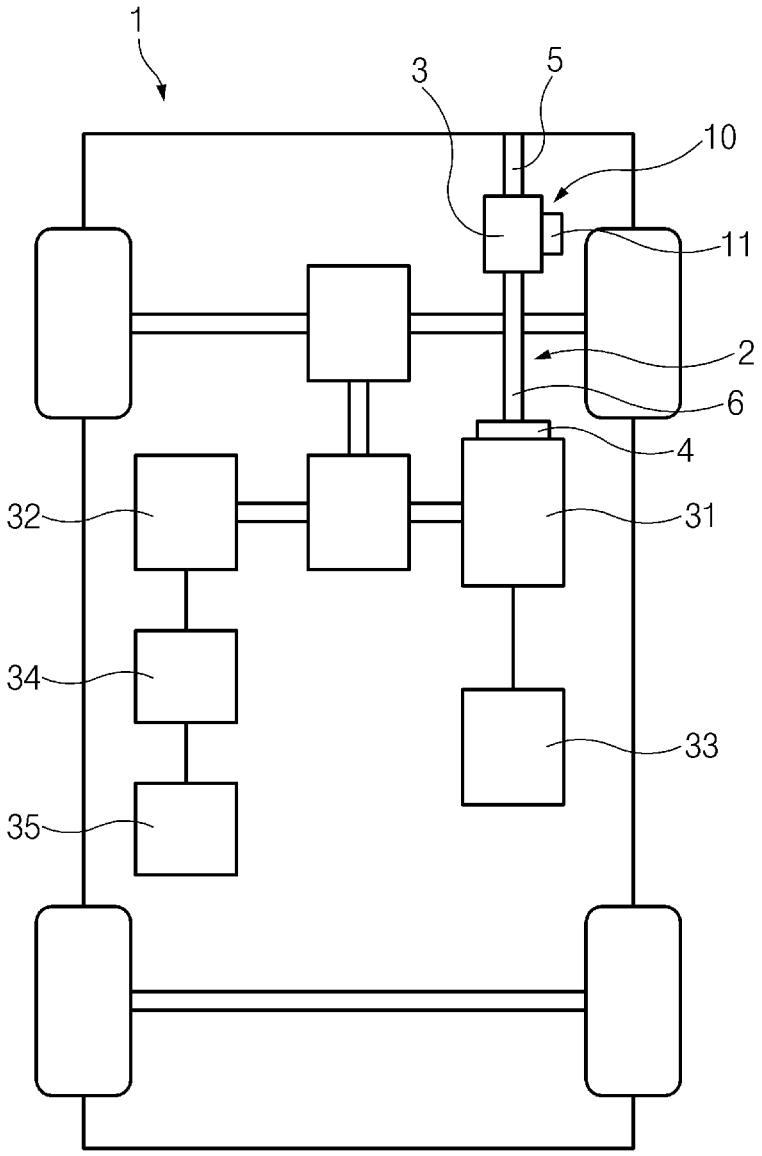
FIG. 1 illustrates the configuration of a vehicle to which a virtual engine sound system according to embodiments of the present disclosure is applied.

Hereinafter, embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

A VESS includes a speaker installed in a grille of the vehicle, and the speaker generates a virtual engine sound.

Meanwhile, in order to deliver the virtual engine sound to pedestrians distant from the vehicle, the virtual engine sound as a low frequency sound. However, the size of the speaker may be limited depending on vehicle specifications. Due to the limitation on the size of the speaker, a typical VESS may have difficulty in reproducing the low frequency sound.

In addition, as the speaker in a typical VESS is mounted on the grille of the vehicle, the speaker may block the inflow of air into a radiator of an engine compartment, and thus cooling efficiency of the vehicle may be lowered.

Meanwhile, when the speaker is mounted on the exterior of the vehicle, dust and other foreign materials may easily be introduced into the speaker, thereby shortening the lifespan of the speaker. In a proposed structure, a speaker and a duct emitting a virtual engine sound generated by the speaker may be mounted in the engine compartment of the vehicle. However, the installation of the duct may increase the manufacturing cost and the weight of the vehicle.

Referring to FIG. 1, a virtual engine sound system 10 for a vehicle, according to embodiments of the present disclosure, may be applied to a vehicle 1 having an internal combustion engine 31 and an electric motor 32, such as a hybrid electric vehicle (HEV) and a plug-in hybrid electric vehicle (PHEV). The internal combustion engine 31 may be connected to an intake system 2 and a fuel tank 33. The electric motor 32 may be connected to a battery 35 through a converter 34.

The virtual engine sound system 10 for a vehicle, according to embodiments of the present disclosure, may be mounted on an intake system 2 which is configured to cause ambient air to flow to the internal combustion engine 31. The virtual engine sound system 10 may transmit a virtual sound to the outside of the vehicle or reduce an engine noise, depending on whether the internal combustion engine 31 is operating or not.

FIG. 1 illustrates the configuration of a parallel hybrid vehicle to which the virtual engine sound system 10 according to embodiments of the present disclosure is applied, but the inventive concept is not limited thereto. The virtual engine sound system 10 according to embodiments of the present disclosure may be applied to various types of hybrid vehicles such as a series hybrid vehicle and a power-split hybrid vehicle.

Figure 2:
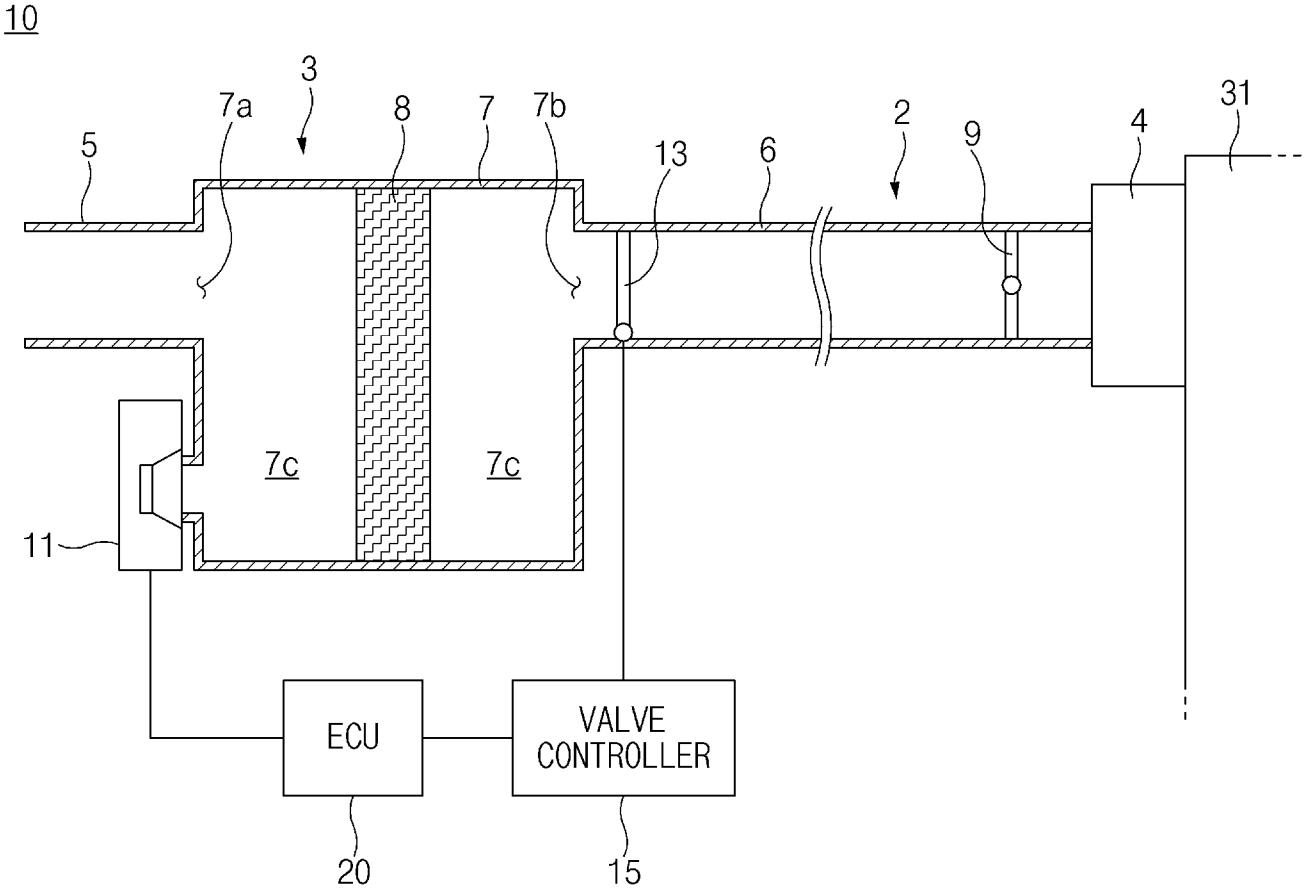
FIG. 2 illustrates a cross-sectional view of a virtual engine sound system for a vehicle, according to an embodiment of the present disclosure.

Referring to FIG. 2, the virtual engine sound system 10 for a vehicle, according to an embodiment of the present disclosure, may include a speaker 11 mounted on the air intake system 2 of the internal combustion engine 31.

The intake system 2 may include an air cleaner 3, an intake manifold 4, intake conduits 5 and 6, and a throttle valve 9.

The air cleaner 3 may include a case 7, and a filter element 8 mounted in the case 7. The case 7 may have an inlet 7*a* through which the ambient air is introduced, an outlet 7*b* through which the ambient air is discharged, and a cavity 7*c* in which the filter element 8 is received. The filter element 8 may filter the ambient air, and be received in the cavity 7*c* of the case 7.

The intake manifold 4 may be mounted on the internal combustion engine 31, and be configured to distribute the ambient air flowing through the intake conduits 5 and 6 to an intake port of the internal combustion engine 31.

The intake conduits 5 and 6 may include an upstream side intake conduit 5 connected to the upstream side of the air cleaner 3, and a downstream side intake conduit 6 connected to the downstream side of the air cleaner 3. More specifically, in embodiments, the upstream side intake conduit 5 may be connected in a sealed manner to the inlet 7*a* of the case 7, and the downstream side intake conduit 6 may be connected in a sealed manner to the outlet 7*b* of the case 7. The downstream side intake conduit 6 may allow communications between the air cleaner 3 and the intake manifold 4.

The throttle valve 9 may be mounted in the downstream side intake conduit 6 to regulate the amount of air flowing into the internal combustion engine 31. In particular, the throttle valve 9 may be placed adjacent to the intake manifold 4, and the opening rate of the throttle valve 9 may be controlled by one or more controllers which include an engine control unit or electronic control unit (ECU) 20.

According to an embodiment, the speaker 11 may generate a virtual sound or an anti-noise sound with inverted phase (also known as antiphase) to the engine noise.

In embodiments, the speaker 11 may be mounted on the upstream side intake conduit 5 or the air cleaner 3 of the intake system 2, so that the virtual sound generated by the speaker 11 may effectively be transmitted to the outside through the upstream side intake conduit 5. In the illustrated embodiment in FIG. 2, the speaker 11 is mounted on a wall of the case 7 at its upstream side such that the speaker sound is emitted to a space between the upstream side intake conduit 5 and the filler 8. In an embodiment, the speaker may be mounted on a wall of the upstream side intake conduit 5 such that the speaker sound is emitted into the upstream side intake conduit 5.

According to an embodiment, the speaker 11 may be mounted on the intake system 2 such that the inflow of air into a radiator of an engine compartment may not be blocked, and thus cooling efficiency of the radiator and the engine may not be lowered.

The ECU 20 may control the speaker 11 to generate the virtual sound or the anti-noise sound. The ECU 20 may generate a virtual sound generating signal or an anti-noise sound generating signal based on vehicle information such as operation or non-operation of the internal combustion engine, speed of the vehicle, RPM of the internal combustion engine, accelerator pedal information, RPM of the electric motor, and current value of the electric motor. The ECU 20 may transmit the virtual sound generating signal or the anti-noise sound generating signal to the speaker 11 so that the speaker 11 may generate the virtual sound or the anti-noise sound.

The ECU 20 may be an engine control unit or electronic control unit including a microprocessor or a central processing unit, a read only memory (ROM), a random access memory (RAM), an electrically programmable read only memory (EPROM), a high speed clock, and the like.

The ECU 20 may receive and process a variety of information, such as operation or non-operation of the internal combustion engine, speed of the vehicle, RPM of the internal combustion engine, accelerator pedal information, RPM of the electric motor, and current value of the electric motor, from a variety of sensors, and transmit control signals to the speaker 11. The ECU 20 may include a processor and a memory. The processor may receive instructions and data stored in the memory, and transmit instructions to the speaker 11. The memory may be a data storage, such as a hard disk drive, a solid state drive, a server, a volatile storage medium, or a non-volatile storage medium.

For example, the ECU 20 may transmit a virtual sound generating signal to the speaker 11 in EV mode of the environmentally friendly vehicle 1. As the speaker 11 receives the virtual sound generating signal, the speaker 11 may generate a virtual sound. Here, the EV mode refers to operating mode in which the internal combustion engine 31 is not operating and the vehicle is only driven by the electric motor 32.

Alternatively, the ECU 20 may transmit an anti-noise sound generating signal to the speaker 11 in an operating condition in which the internal combustion engine 31 of the environmentally friendly vehicle 1 is operating. As the speaker 11 receives the anti-noise sound generating signal, the speaker 11 may generate an anti-noise sound.

According to an embodiment, the outlet 7*b* of the air cleaner 3 may be selectively opened and closed by a valve 13, and the valve 13 may be controlled by a valve controller 15.

The valve 13 may be configured to move between a closed position in which the valve 13 closes the outlet 7*b* of the air cleaner 3 (see FIG. 3) and an open position in which the valve 13 opens the outlet 7*b* of the air cleaner 3 (see FIG. 4), depending on whether or not the internal combustion engine 31 is operating.

As illustrated in FIG. 2, in embodiments, the valve 13 may be pivotally mounted in the downstream side intake conduit 6, and the valve 13 may be placed adjacent to the outlet 7*b* of the air cleaner 3. When the valve 13 moves to the closed position (see FIG. 3) in an operating condition in which the internal combustion engine 31 is not operating (that is, in EV mode), the valve 13 may close the downstream side intake conduit 6 so that the outlet 7*b* of the air cleaner 3 may be closed. When the valve 13 moves to the open position (see FIG. 4) in an operating condition in which the internal combustion engine 31 is operating, the valve 13 may open the downstream side intake conduit 6 so that the outlet 7*b* of the air cleaner 3 may be opened.

The valve controller 15 may be electrically connected to the ECU 20. The valve controller 15 may control the valve 13 based on the variety of information, such as operation or non-operation of the internal combustion engine 31, speed of the vehicle, RPM of the internal combustion engine 31, accelerator pedal information, RPM of the electric motor, and current value of the electric motor, received from the ECU 20 and/or the sensors.

For example, the valve controller 15 may control the opening rate of the valve 13, depending on speed of the vehicle, a rotational speed (e.g., RPM) of the internal combustion engine 31, accelerator pedal information, and the like.

The valve controller 15 may include a microprocessor or a central processing unit, a read only memory (ROM), a random access memory (RAM), an electrically programmable read only memory (EPROM), a high speed clock, and the like.

The valve controller 15 may receive the information, such as operation or non-operation of the internal combustion engine 31, speed of the vehicle, RPM of the internal combustion engine 31, accelerator pedal information, a rotational speed (e.g., RPM) of the electric motor, and current value of the electric motor, from the ECU 20 and/or the sensors, and transmit control signals to the valve 13. The valve controller 15 may include a processor and a memory. The processor may receive instructions and data stored in the memory, and transmit instructions to actuators. The memory may be a data storage, such as a hard disk drive, a solid state drive, a server, a volatile storage medium, or a non-volatile storage medium.

The valve controller 15 may be a stand-alone device or may be embedded in the ECU 20.

The valve 13 may be sufficiently spaced apart from the throttle valve 9 in the downstream side intake conduit 6, and the valve controller 15 may control the opening rate of the valve 13 in connection with the operation of the throttle valve 9. When the ECU controls the opening rate of the throttle valve 9, the valve controller 15 may control the opening rate of the valve 13 in connection with the control of the ECU 20 so that the air intake amount may be more fine-tuned.

According to an embodiment, as illustrated in FIG. 2, the speaker 11 may be mounted to communicate with the cavity 7*c* of the air cleaner 3, and the virtual sound or the anti-noise sound generated by the speaker 11 may pass through the cavity 7*c* of the air cleaner 3 and be transmitted to the upstream side intake conduit 5.

Figure 3:
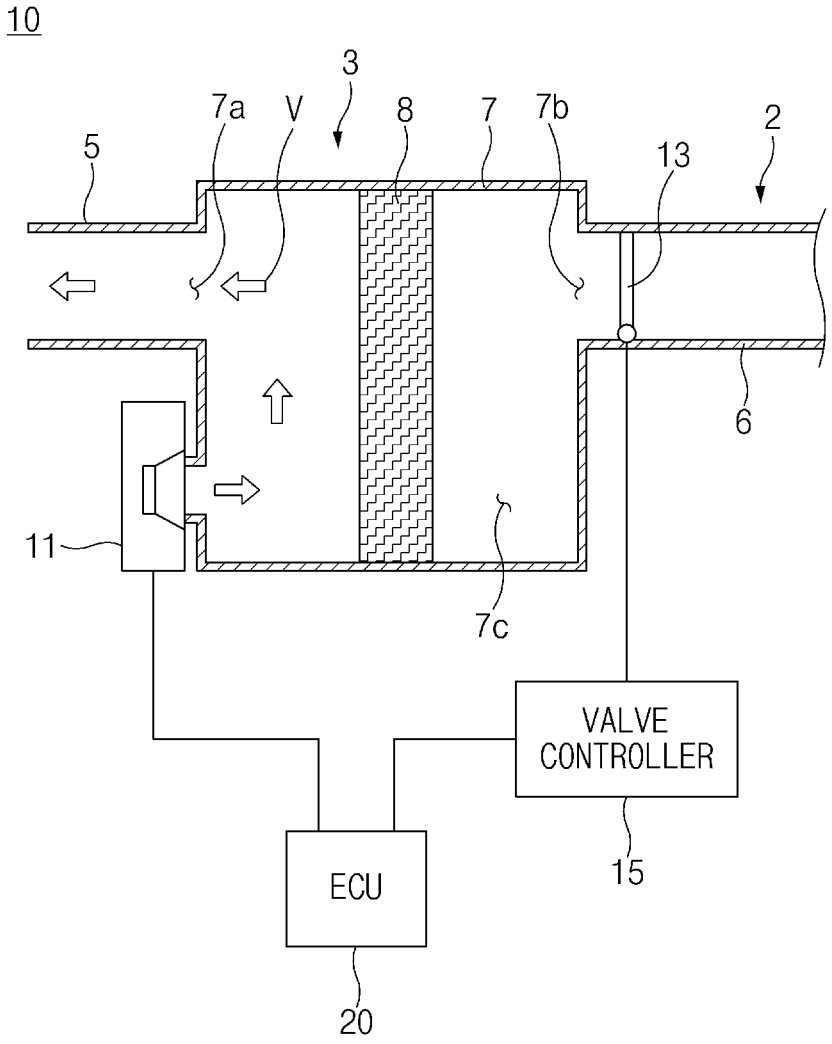
FIG. 3 illustrates a process of transmitting a virtual sound in a virtual engine sound system when a vehicle is in EV mode.

As illustrated in FIG. 3, since it is not required to provide the flow of ambient air in an operating condition in which the internal combustion engine 31 is not operating and the electric motor 32 is operating (that is, in EV mode), the valve 13 may move to the closed position in which the valve 13 closes the outlet 7*b* of the air cleaner 3. The ECU 20 may transmit a virtual sound generating signal to the speaker 11 in the state in which the valve 13 closes the outlet 7*b* of the air cleaner 3, so that the speaker 11 may generate a virtual sound (see arrow "V" in FIG. 3) corresponding to the virtual sound generating signal. Since the outlet 7*b* of the air cleaner 3 is closed, the generated virtual sound may not be transmitted to the interior of the vehicle 1, but may be effectively transmitted from the speaker 11 to the outside of the vehicle 1 through the cavity 7*c* of the air cleaner 3 and the upstream side intake conduit 5.

Meanwhile, in the state in which the valve 13 closes the outlet 7*b* of the air cleaner 3, the virtual sound generated by the speaker 11 may resonate while passing through the cavity 7*c* of the air cleaner 3, so that the virtual sound from the speaker 11 may be converted into sounds of various frequencies such as a low frequency sound or a high frequency sound. In this embodiment, the cavity 7*c* of the air cleaner 3 may function as a resonator so that a low frequency sound may be effectively generated without increasing the size of the speaker 11. The virtual sound generated by the speaker 11 may resonate in the cavity 7*c* of the air cleaner 3, so that the amplification of the low frequency sound may be facilitated.

Figure 4:
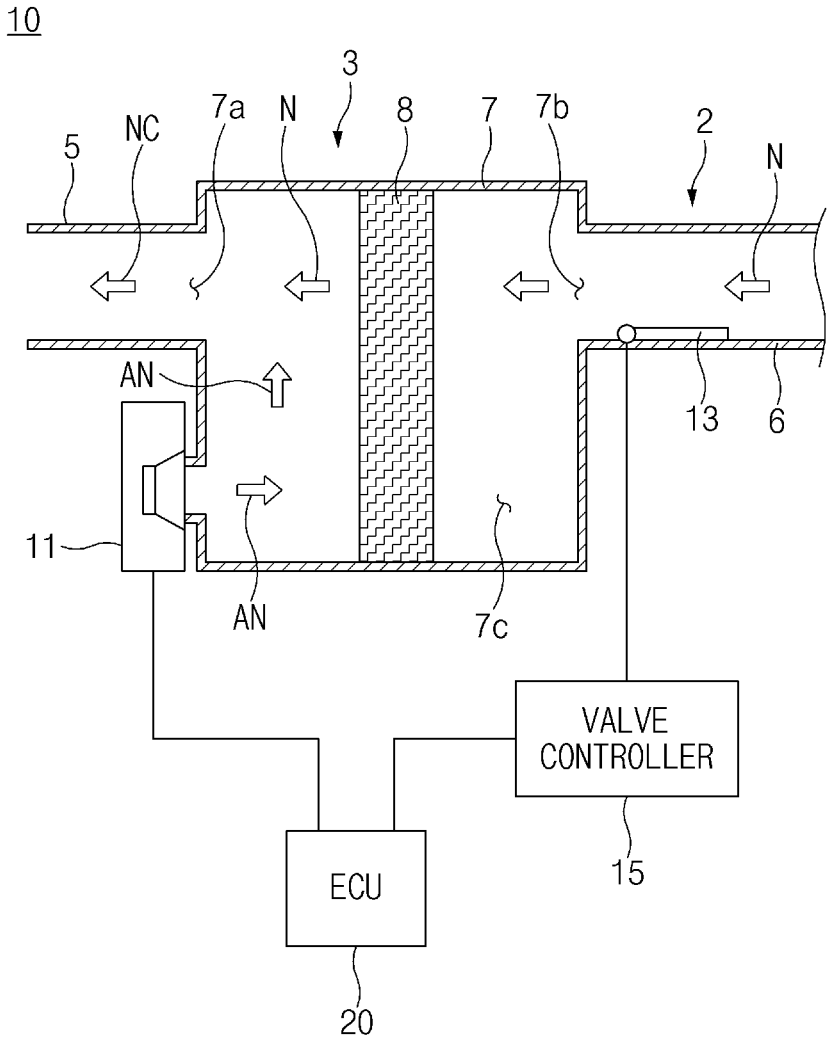
FIG. 4 illustrates a process of reducing an engine noise by an anti-noise sound in a virtual engine sound system in an operating condition in which an internal combustion engine of a vehicle is operating.

As illustrated in FIG. 4, since it is required to provide the flow of ambient air in an operating condition in which the internal combustion engine 31 is operating, the valve 13 may move to the open position in which the valve 13 opens the outlet 7*b* of the air cleaner 3. In this state, the ambient air may pass through the upstream side intake conduit 5, the air cleaner 3, and the downstream side intake conduit 6 and be transmitted to the internal combustion engine 31. Engine noise (see arrow "N" in FIG. 4) generated by the operation of the internal combustion engine 31 may be transmitted to the outlet 7*b* of the air cleaner 3 through the downstream side intake conduit 6, and the speaker 11 may generate an anti-noise sound (see arrow "AN" in FIG. 4) designed to cancel the engine noise N under control of the ECU 20. As the engine noise N is cancelled by the anti-noise sound AN, the engine noise N may be reduced.

Figure 5:
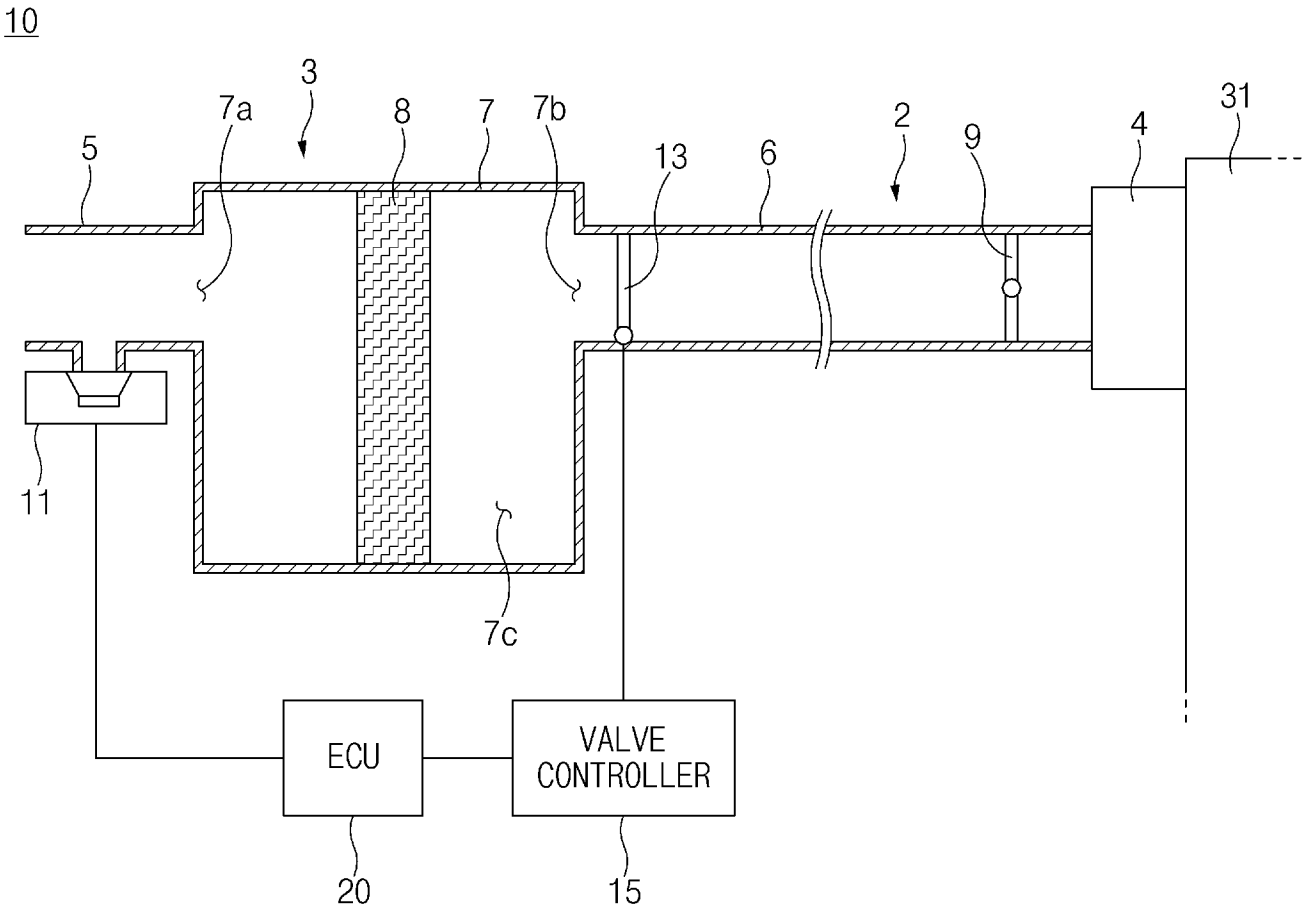
FIG. 5 illustrates a cross-sectional view of a virtual engine sound system for a vehicle, according to another embodiment of the present disclosure.

According to another embodiment, as illustrated in FIG. 5, the speaker 11 may be mounted to face the internal space of the upstream side intake conduit 5 of the intake system 2, so that the virtual sound or the anti-noise sound generated by the speaker 11 may directly be transmitted to the outside of the vehicle through the upstream side intake conduit 5. Since the other configuration and operations in this embodiment are similar to those in the embodiments illustrated in FIGS. 2 to 4, a detailed description thereof will be omitted.

According to the above-described embodiments of the present disclosure, the virtual engine sound system is capable of effectively transmitting virtual sound of various frequencies to the outside of the environmentally friendly vehicle when operating in EV mode, and effectively reducing engine noise when the internal combustion engine is operating.

As set forth above, the virtual engine sound system, according to embodiments of the present disclosure, may allow the speaker to generate a virtual sound or an anti-noise sound for reducing engine noise, depending on whether the internal combustion engine is operating or not, so that it may effectively transmit the virtual sound to the outside of the vehicle in EV mode and effectively reduce the engine noise in the operating condition in which the internal combustion engine is operating.

According to embodiments of the present disclosure, the speaker may be mounted on the intake system which is configured to conduct the ambient air to the internal combustion engine such that the inflow of air into the radiator of the engine compartment may not be blocked, and thus cooling efficiency of the radiator and the engine may not be lowered.

In addition, as the valve closes the outlet of the air cleaner in the operating condition in which the internal combustion engine is operating (that is, in EV mode), the virtual sound may not be transmitted to the interior of the vehicle, but may be directly transmitted to the outside of the vehicle, and thus it may be very effectively transmitted to the outside of the vehicle.

Logical blocks, modules or units described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A virtual engine sound system for a vehicle, the virtual engine sound system comprising:

a speaker mounted on an intake system, and configured to generate an anti-noise sound with inverted phase to an engine noise of an internal combustion engine and a virtual sound;

a valve which is movable between an open position in which an outlet of an air cleaner is opened and a closed position in which the outlet of the air cleaner is closed;

a valve controller configured to control the valve to move between the open position and the closed position, depending on whether the internal combustion engine is operating; and one or more controllers configured to control the speaker and further configured to control operation of the valve;

wherein the one or more controllers are configured to control the speaker to generate the anti-noise sound in an operating condition in which the internal combustion engine is operating, and further configured to control the speaker to generate the virtual sound in an operating condition in which the internal combustion engine is not operating, wherein the valve and a throttle valve are mounted in a downstream side intake conduit connected to the outlet of the air cleaner, wherein the valve is disposed between the outlet of the air cleaner and the throttle valve, wherein the valve is disposed upstream from the throttle valve, wherein the valve controller controls the opening rate of the valve in connection with the operation of the throttle valve.

2. The virtual engine sound system according to claim 1, wherein the speaker is mounted on at least one of the air cleaner and an upstream side intake conduit connected to an inlet of the air cleaner.

3. The virtual engine sound system according to claim 2, wherein the speaker is mounted to face a cavity of the air cleaner.

4. The virtual engine sound system according to claim 2, wherein the speaker is mounted to face an inside of the upstream side intake conduit.

5. The virtual engine sound system according to claim 1, wherein the valve controller is configured to control the valve to move to the open position when the internal combustion engine is operating.

6. The virtual engine sound system according to claim 1, wherein the valve controller is configured to control the valve to move to the closed position when the internal combustion engine is not operating.

7. The virtual engine sound system according to claim 1, wherein the one or more controllers comprises an ECU configured to control the speaker and operation of the engine.

* * * * *